US005735971A

United States Patent [19]

Wahl et al.

[11] Patent Number: 5,735,971

[45] Date of Patent: Apr. 7, 1998

[54] METHOD FOR THE PRE-TREATMENT OF STEEL PARTS PRIOR TO SALT BATH NITRIDING

[75] Inventors: Georg Wahl; Rainer Willing-Lepenies, both of Rodenbach, Germany

[73] Assignee: Durferrit GmbH Thermotechnik, Mannheim, Germany

[21] Appl. No.: 563,547

[22] Filed: Nov. 28, 1995

[30] Foreign Application Priority Data

Nov. 29, 1994 [DE] Germany ..... 44 42 328.4

[51] Int. Cl.[6] ..... C23C 8/02; C23C 8/40

[52] U.S. Cl. ..... 148/217; 148/218; 148/242

[58] Field of Search ..... 148/217, 218, 148/242

[56] References Cited

U.S. PATENT DOCUMENTS 3,915,759 10/1975 Smollett ..... 148/242

5,022,934 6/1991 Schwing ..... 148/218

5,102,476 4/1992 Wahl ..... 148/218

FOREIGN PATENT DOCUMENTS 463 10/1987 Japan ..... 148/217

425574 9/1992 Japan ..... 148/217

*Primary Examiner*—Sam Silverberg

*Attorney, Agent, or Firm*—Beveridge, DeGrandi, Weilacher & Young, L.L.P.

[57] ABSTRACT

Flawless nitrating layers are obtained during the nitro-carburizing of components made from steels which form passive layers in salt baths if these components are first pre-treated in an oxidizing salt melt at 300° to 500° C. prior to the nitro-carburizing process.

7 Claims, No Drawings

METHOD FOR THE PRE-TREATMENT OF STEEL PARTS PRIOR TO SALT BATH NITRIDING

INTRODUCTION AND BACKGROUND

The invention relates to a method for the pre-treatment of components made from steels which form passive layers, in particular from steels with more than 10 wt % of chromium and/or more than 4 wt % of nickel, prior to nitro-carburizing in salt baths.

Alloyed steels, which contain greater amounts of chromium, nickel and/or other additives, form with the air passive layers which consist mainly of oxides of the alloying metals. These passive layers, although they produce an enhanced corrosion-resistance of these steels, are nevertheless a hindrance during a nitro-carburizing of such steel components in cyanide- and cyanate-containing salt baths, since the passive layers make the diffusion of nitrogen and carbon out of the salt bath into the steel surface more difficult and lead to defective nitrating layers.

An attempt has been made to date to overcome these disadvantages by using for the nitro-carburizing of high-alloy steels salt baths with a high cyanide content, which have a reducing action on the passive layers. These salt baths with a high cyanide content are however highly polluting.

SUMMARY OF THE INVENTION

The object of the present invention was therefore to develop a method for the pre-treatment of components made from steels that are capable of forming passive layers, in particular from steels with a content of more than 10 wt % of chromium and/or more than 4 wt % of nickel, prior to nitro-carburizing in salt baths, with which a flawless nitro-carburizing is achieved despite the passive layers present.

The above and other objects are achieved according to the invention by a process wherein the steel parts are treated in an oxidizing salt melt at 300° to 5000° C.

It is a feature of the invention to pre-treat steel parts especially those having a content of more than 10 wt. % of chromium and/or more than 4 wt % of nickel with an alkali metal salt both prior to nitro-carburizing carried out in cyanide- and cyanate-containing salt baths.

The technology of nitro-carburizing is well developed. It is sometimes referred to as nitriding and is carried out by subjecting steel to the action of a nitrogenous medium under conditions whereby surface hardeness is imparted. See Kirk—Othmer, Encyclopedia of Chemical Technology 3rd Ed., Vol. 21 page 604; see also The Illustrated Science and Invention Encyclopedia, Vol. 9, p. 1196, H. S. Stuttman Co. N.Y.C.

DETAILED DESCRIPTION OF INVENTION

A mixture of alkali nitrate, alkali hydroxide and alkali carbonate is preferably used as the oxidizing salt melt in carrying out the present invention. Salt melts containing 5 to 30 wt % of alkali nitrate, remainder alkali hydroxide and alkali carbonate, have proved particularly successful. Although the nature of the alkali metal can vary, sodium or potassium are preferred with sodium being the most preferred alkali metal.

The salt melts are operated advantageously at 330° to 420° C., for a sufficient duration of time to facilitate the subsequent nitro-carburizing process. For example, a time span of 5 to 30 minutes has proved to be suitable for the period of treatment. Of course, the time can be varied as desired based on routine experimentation.

It is very surprising that despite a strengthening of the passive layers in an oxidizing salt melt, flawless nitro-carburizing layers are subsequently obtained in cyanide- and cyanate-containing salt baths.

Oxidizing salt baths are known per se for the nitro-carburizing of ferrous products (e.g. DE-PS 29 34 113), but they have been used to date only after the nitro-carburizing in order to increase the corrosion-resistance.

The following examples serve to explain in detail the method according to the invention.

1. Components made from a steel with 23% chromium and 8% nickel were nitro-carburized in a salt bath (some 4 wt % cyanide, some 37 wt % cyanate, remainder alkali) for 90 minutes at580° C. A defective nitro-carburizing layer was formed, which possessed different layer thicknesses. If these components were prior to the nitro-carburizing dipped for 25 minutes at 370° C. in an alkali hydroxide melt which contained 10 wt % of sodium nitrate, flawless layers possessing the same overall thickness were obtained during the nitro-carburizing.

2. The same tests were conducted with components made from the steels 1.4028 (13% chromium) and 1.4112 (18% chromium). The metallographic analysis produced for the samples pre-treated in the oxidizing salt melt a uniform formation of the nitrating layer, whereas the non-pre-treated samples showed a non uniform, wavy nitrating layer.

Further variations and modifications of the foregoing will be apparent to those skilled in the art from the foregoing and are intended to be encompassed by the claims appended hereto.

German priority application P 44 42 328.4 is relied on and incorporated herein by reference.

We claim:

1. A method for the pre-treatment of a component made from steel containing more than 10 wt % of chromium and/or more than 4 wt % of nickel which forms passive layers on the surface thereof, comprising treating said component in an oxidizing salt melt at 300° to 500° C. and thereafter nitro-carburizing said component in a cyanide- or cyanate-containing salt bath to thereby achieve flawless nitro-carburizing.

2. The method according to claim 1, wherein the oxidizing salt melt consists of a mixture of alkali nitrate, alkali hydroxide and alkali carbonate.

3. The method according to claim 2, wherein the salt melt contains 5 to 30 wt % of alkali nitrate, remainder alkali hydroxide and alkali carbonate.

4. The method according to claim 1, wherein said salt melt contains an alkali metal salt.

5. The method according to claim 4, wherein sodium is the alkali metal.

6. The method according to claim 1, wherein said component is treated in the oxidizing salt melt at temperatures from 330° to 420°.

7. The method according to claim 1, further comprising wherein said treating takes place for 5 to 30 minutes.

* * * * *